US011964218B2

(12) United States Patent
Baumann et al.

(10) Patent No.: US 11,964,218 B2
(45) Date of Patent: Apr. 23, 2024

(54) TOY SYSTEMS WITH SUCTION PORTION FOR AUDIBLE INTERACTION AND ENTERTAINMENT

(71) Applicant: Procreate Brands, LLC, Ferndale, WA (US)

(72) Inventors: Scott Baumann, Anacortes, WA (US); Edwin Cheong, Blaine, WA (US)

(73) Assignee: Procreate Brands, LLC, Ferndale, WA (US)

( * ) Notice: Subject to any disclaimer, the term of this patent is extended or adjusted under 35 U.S.C. 154(b) by 0 days.

(21) Appl. No.: 18/212,330

(22) Filed: Jun. 21, 2023

(65) Prior Publication Data

US 2023/0330549 A1 Oct. 19, 2023

Related U.S. Application Data

(63) Continuation of application No. 17/650,355, filed on Feb. 8, 2022, now Pat. No. 11,717,763, which is a continuation of application No. 16/858,229, filed on Apr. 24, 2020, now Pat. No. 11,305,206, which is a continuation-in-part of application No. 29/712,241, filed on Nov. 6, 2019, now Pat. No. Des. 972,044.

(60) Provisional application No. 62/837,962, filed on Apr. 24, 2019.

(51) Int. Cl.
*A63H 5/00* (2006.01)

(52) U.S. Cl.
CPC ..... *A63H 5/00* (2013.01)

(58) Field of Classification Search
CPC ..... A63H 5/00; A63H 37/005
See application file for complete search history.

(56) References Cited

U.S. PATENT DOCUMENTS

| | | | | |
|---|---|---|---|---|
| 2,459,300 A * | 1/1949 | Wolf | A63H 5/04 | 446/407 |
| 2,885,824 A * | 5/1959 | Lemelson | A63H 11/06 | 273/DIG. 25 |
| 2,952,460 A * | 9/1960 | Ellis | A63B 43/00 | 446/486 |
| 2,968,121 A * | 1/1961 | Pearson, Jr. | A63H 37/00 | 403/166 |
| 2,975,550 A * | 3/1961 | Miller | A63H 11/06 | 446/184 |
| 3,029,557 A * | 4/1962 | Lemelson | A63H 5/00 | 446/398 |

(Continued)

*Primary Examiner* — John A Ricci
(74) *Attorney, Agent, or Firm* — Kevin Keener; Keener and Associates P.C.

(57) ABSTRACT

A toy comprises a resiliently deformable member, a first contactor defining a first contacting surface, and a second contactor defining a second contacting surface. At least one of the first and second contactors defines a concave surface. The resiliently deformable member supports the first and second contactors for movement along a main axis between an engaged configuration in which the first contacting surface is contact with the second contacting surface and a disengaged configuration in which the first contacting surface is disengaged from the second contacting surface. The resiliently deformable member biases the first and second contactors in opposite directions along the main axis. Application of force to displace the first and second contactors along the main axis creates a sound when the first and second contactors are disengaged from each other.

20 Claims, 12 Drawing Sheets

(56) References Cited

U.S. PATENT DOCUMENTS

| | | | | |
|---|---|---|---|---|
| 3,526,991 | A * | 9/1970 | Goldfarb | A63H 11/06 273/DIG. 25 |
| 3,702,038 | A * | 11/1972 | Hakim | A63H 3/28 446/184 |
| 6,863,588 | B1 * | 3/2005 | Chu | A63H 33/18 473/588 |
| 6,896,577 | B1 * | 5/2005 | Feng | A63H 33/18 446/92 |
| 11,305,206 | B1 * | 4/2022 | Baumann | A63H 5/00 |
| 11,717,763 | B1 * | 8/2023 | Baumann | A63H 5/00 446/397 |
| 2008/0233832 | A1 * | 9/2008 | Lirot | A63H 37/005 446/459 |

* cited by examiner

TOY SYSTEMS WITH SUCTION PORTION FOR AUDIBLE INTERACTION AND ENTERTAINMENT

RELATED APPLICATIONS

This application is a continuation of U.S. patent application Ser. No. 17/650,355, filed on Feb. 8, 2022 and currently pending. U.S. application Ser. No. 17/650,355 is a continuation of U.S. patent application Ser. No. 16/858,229, filed on Apr. 24, 2020, which issued into U.S. Pat. No. 11,305,206 on Apr. 19, 2022. U.S. application Ser. No. 16/858,229 is a continuation in part of U.S. Design Patent Application Ser. No. 29/712,241, filed on Nov. 8, 2019, which issued into U.S. Pat. No. D972,044 on Dec. 6, 2022. U.S. application Ser. No. 16/858,229 claims the benefit of U.S. Provisional Application Ser. No. 62/837,962 filed on Apr. 24, 2019.

TECHNICAL FIELD

The present invention relates generally to interactive toy systems, and particularly to interactive toy systems in which the component of suction is utilized to emit audible sounds when physically compressed and released.

BACKGROUND

The need exists for a toy devices, systems, and methods that that amuse and relieve stress.

SUMMARY

The present invention may be embodied as a toy comprising a resiliently deformable member, a first contactor defining a first contacting surface, and a second contactor defining a second contacting surface. At least one of the first and second contactors defines a concave surface. The resiliently deformable member supports the first and second contactors for movement along a main axis between an engaged configuration in which the first contacting surface is contact with the second contacting surface and a disengaged configuration in which the first contacting surface is disengaged from the second contacting surface. The resiliently deformable member biases the first and second contactors in opposite directions along the main axis. Application of force to displace the first and second contactors along the main axis creates a sound when the first and second contactors are disengaged from each other.

The present invention may also be embodied as a method of creating sound comprising the following steps. A resiliently deformable member is provided. First and second contactors defining a first and second contacting surfaces, respectively, are provided. At least one of the first and second contactors defines a concave surface. The first and second contactors are supported on the resiliently deformable member for movement along a main axis between an engaged configuration in which the first contacting surface is contact with the second contacting surface and a disengaged configuration in which the first contacting surface is disengaged from the second contacting surface. The resiliently deformable member is configured to bias the first and second contactors in opposite directions along the main axis. The first and second contactors are displaced along the main axis to disengage the first and second contactors from each other to create a sound.

The present invention may also be embodied as a toy comprising a closed frame resiliently deformable between an undeformed configuration and a deformed configuration, a first contactor defining a first contacting surface, and a second contactor defining a second contacting surface. At least one of the first and second contactors defines a concave surface. The closed frame supports the first and second contactors for movement along a main axis between an engaged configuration in which the first contacting surface is contact with the second contacting surface and a disengaged configuration in which the first contacting surface is disengaged from the second contacting surface. The closed frame biases the first and second contactors in opposite directions along the main axis. Application of force to displace the first and second contactors along the main axis creates sound when the first and second contactors are disengaged from each other.

DETAILED DESCRIPTION

Figure 1:
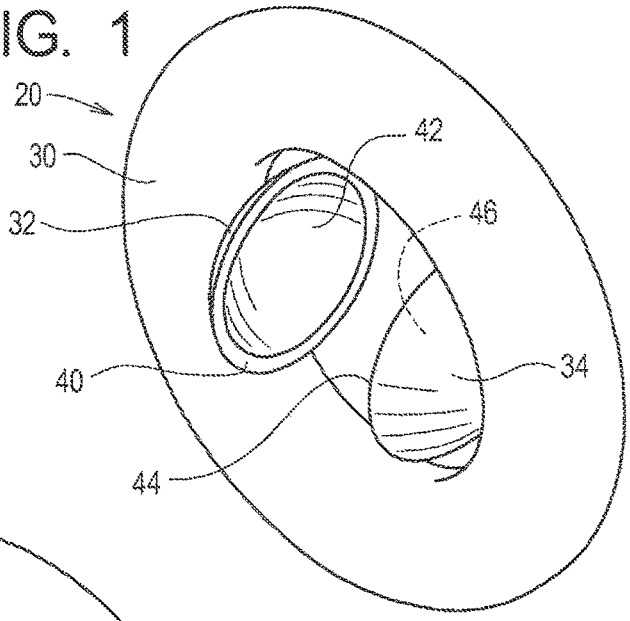
FIG. 1 is a perspective front view of a first example interactive toy of the present invention.

The present invention may be embodied and manufactured in different forms, and a number of example embodiments of and methods of manufacturing the present invention will be described separately herein.

I. First Example Toy

Referring initially to FIGS. 1-4 of the drawing, depicted therein is a first example toy 20 constructed in accordance with, and embodying, the principles of the present invention. The example toy 20 comprises a frame 30, a first contactor 32, and a second contactor 34. The example frame 30, first contactor 32, and second contactor 34 are resiliently deformable. The first contactor 32 defines a first contacting surface 40 and a first concave surface 42, and the second contactor 34 defines a second contacting surface 44 and a second concave surface 46. The example frame 22 supports the first and second contactors 32 and 34 such that the first contacting surface 40 faces and is substantially aligned with the second contacting surface 44 along a main axis A.

Figure 2:
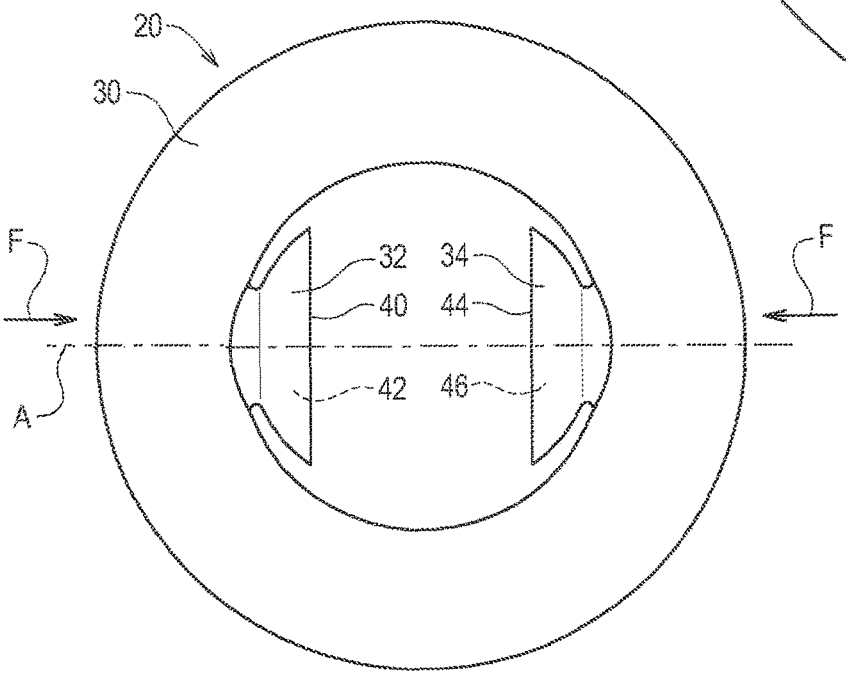
FIG. 2 is a first elevation view of the first example interactive toy, the opposite elevation view being identical.
Figure 3:
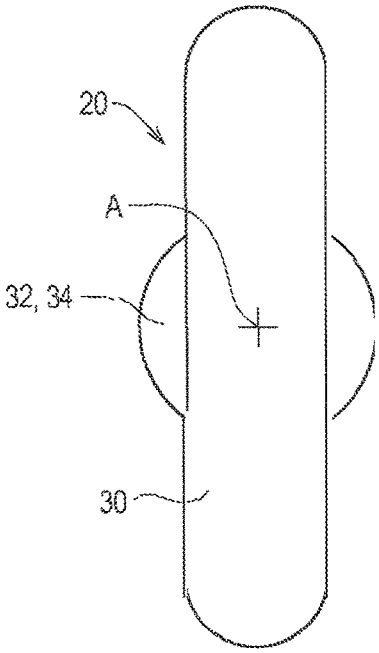
FIG. 3 is a second elevation view of the first example interactive toy, the opposite elevation view being identical.
Figure 4:
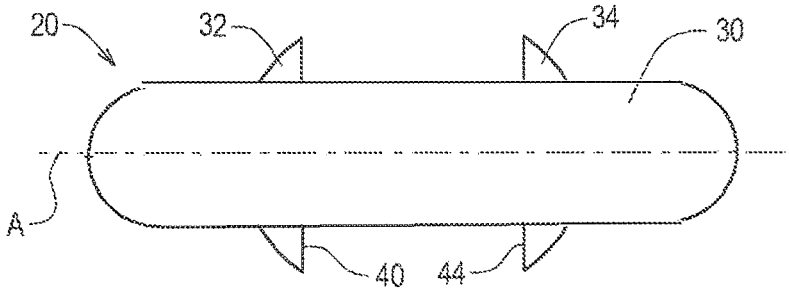
FIG. 4 is a top plan view of the first example interactive toy, the bottom plan view being identical.
Figure 5:
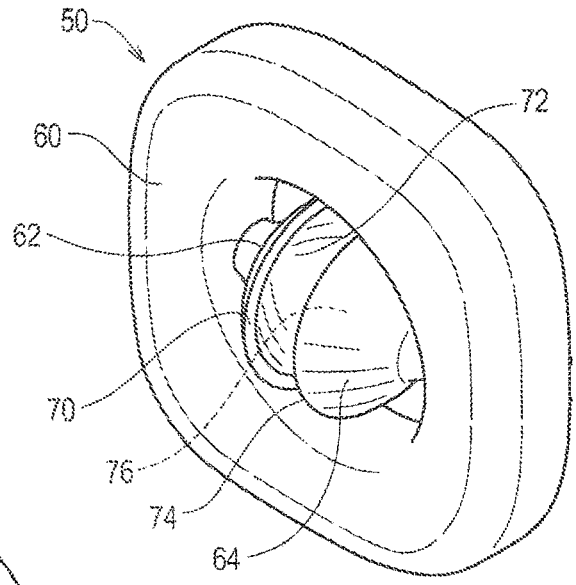
FIG. 5 is a perspective front view of a second example interactive toy of the present invention.
Figure 6:
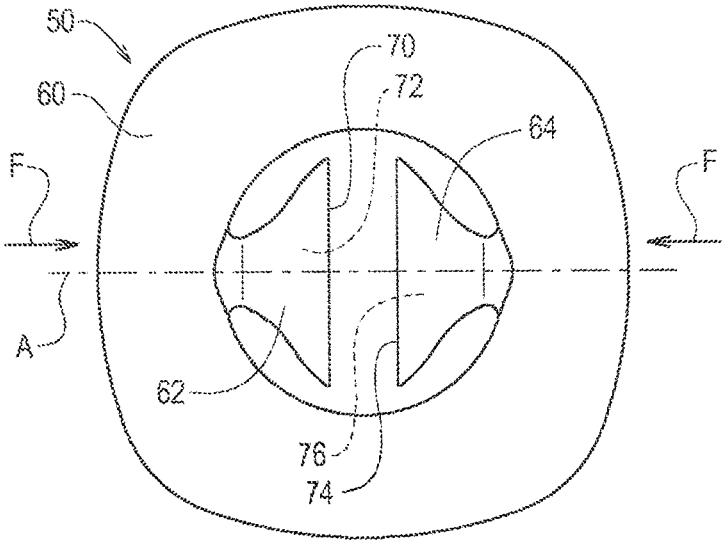
FIG. 6 is a first elevation view of the second example interactive toy, the opposite elevation view being identical.
Figure 7:
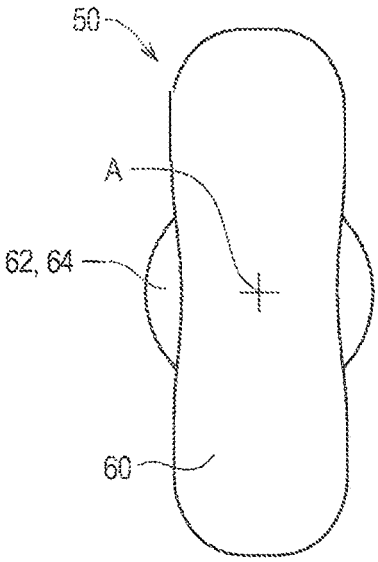
FIG. 7 is a second elevation view of the second example interactive toy, the opposite elevation view being identical.
Figure 8:
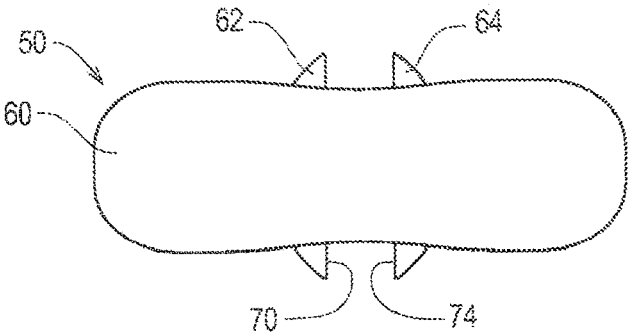
FIG. 8 is a top plan view of the second example interactive toy, the bottom plan view being identical.
Figure 9:
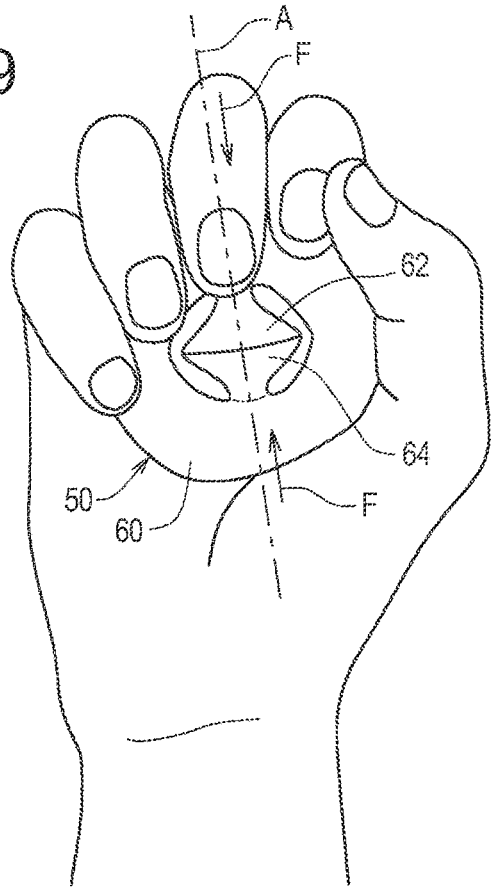
FIG. 9 is a front elevation view illustrating use of the second example interactive toy in a compressed configuration.
Figure 10:
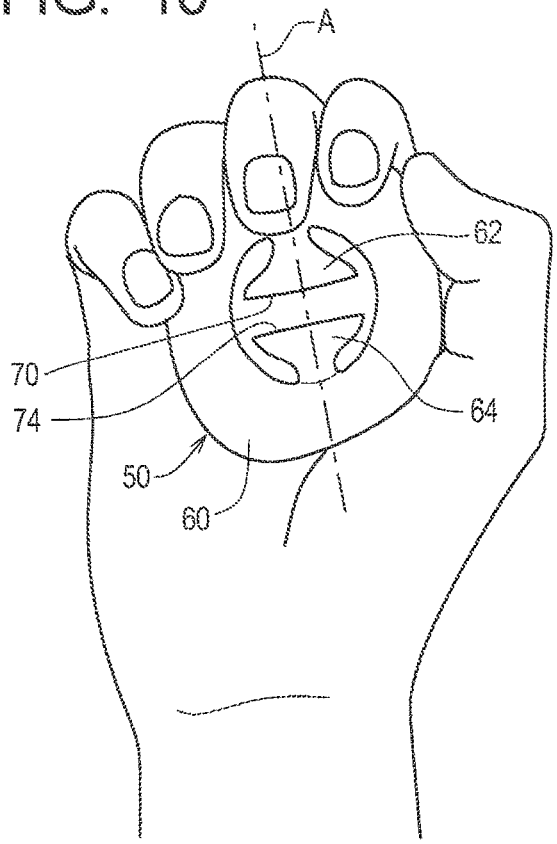
FIG. 10 is a front elevation view illustrating use of the second example interactive toy in an expanded configuration.

When the frame 30 is in an undeformed configuration as shown in FIGS. 1, 2, and 4, the first contacting surface 40 is spaced from the second contacting surface 42. The frame 30 biases the first and second contactors 32 and 34 in opposite directions (away from each other) along the main axis A. Applying a force on the frame 30 as shown by arrows Fin FIG. 2 deforms the frame 30 against the biasing force into a contact configuration such that the first and second contacting surfaces 40 and 44 move toward each other along the main axis A and engage each other to define a closed chamber that traps a predetermined volume of air. The closed chamber is sealed as long as the first and second contacting surfaces 40 and 44 are held in contact. Further application of force in the direction shown by arrows F into a fully deformed configuration forces at least a portion of the predetermined volume of air out of closed chamber, creating low air pressure within the closed chamber relative to ambient air pressure outside of the closed chamber. At this point, releasing the force shown by arrows F allows biasing force to return the frame 30 to the undeformed configuration, moving the first and second contactors 32 and 34 away from each other. As the frame 30 moves through the contacting configuration back into the undeformed configuration, the first and second contacting surfaces 40 and 44 disengage with each other. As the first and second contacting surfaces 40 and 44 disengage with each other, the reduced pressure air within the closed chamber and the resilient deformability of at least one of the first and second contactors 32 and 34 causes a snapping or popping sound.

The first example frame 30 is annular (e.g., toroidal), and the example first and second contactors 32 and 34 are supported on opposing inner sides defined the frame 30. The example first and second contacting surfaces 40 and 44 are annular. The example first and second concave surfaces 42 and 46 are substantially parabolic in cross-section.

The size, dimensions, and resiliency of the example frame 30 and of the example contactors 32 and 34 is predetermined such that deliberate application of manual force may be used to alter the frame from the undeformed configuration to the fully deformed position. The size, dimensions, and resiliency of the example frame 30 and of the example contactors 32 and 34 is further predetermined such that, when the forces F on the example frame 30 are released, the example frame 30 overcomes the suction established by the low pressure within the closed chamber and the frame self-reconfigures from the fully deformed position to the undeformed position without application of external force. Manually gripping (or squeezing) and releasing the opposite outer sides of the example frame along the main axis A can thus create a popping or snapping sound.

II. Second Example Toy

Referring now to FIGS. 5-10 of the drawing, a second example toy 50 constructed in accordance with, and embodying, the principles of the present invention will be described. The example toy 50 comprises a frame 60, a first contactor 62, and a second contactor 64. The example frame 60, first contactor 62, and second contactor 64 are resiliently deformable. The first contactor 62 defines a first contacting surface 70 and a first concave surface 72, and the second contactor 64 defines a second contacting surface 7 4 and a second concave surface 76. The example frame 60 supports the example first and second contactors 62 and 64 such that the first contacting surface 70 faces and is substantially aligned, along a main axis A, with the second contacting surface 74.

When the frame 60 is in an undeformed configuration as shown in FIGS. 5, 6, 8, and 10, the first contacting surface 70 is spaced from the second contacting surface 72. The frame 60 biases the first and second contactors 62 and 64 in opposite directions (away each other) along the main axis A. Applying a force on the frame 60 as shown by arrows Fin FIG. 5 deforms the frame 60 into a contact configuration (FIG. 9) such that the first and second contacting surfaces 70 and 7 4 move toward each other along the main axis A and engage each other to define a closed chamber that traps a predetermined volume of air. The closed chamber is sealed as long as the first and second contacting surfaces 70 and 74 are held in contact. Further application of force in the direction shown by arrows F into a fully deformed configuration forces at least a portion of the predetermined volume of air out of closed chamber, creating low air pressure within the closed chamber relative to ambient air pressure outside of the closed chamber. At this point, releasing the force shown by arrows F allows internal biasing force of the frame 60 to return the frame 60 to the undeformed configuration. As the frame 60 moves through the contacting configuration back into the undeformed configuration, the first and second contacting surfaces 70 and 74 disengage with each other. As the first and second contacting surfaces 70 and 74 disengage with each other, the reduced pressure air within the closed chamber and the resilient deformability of at least one of the first and second contactors 62 and 64 causes a snapping or popping sound.

The second example frame 60 is rectangular, and the example first and second contactors 62 and 64 are supported on opposite inner surfaces defined the annular frame 60. The example first and second contacting surfaces 70 and 74 are annular. The example first and second concave surfaces 72 and 76 are substantially parabolic in cross-section.

The size, dimensions, and resiliency of the example frame 60 and of the example contactors 62 and 64 is predetermined such that deliberate application of manual force may be used to alter the frame from the undeformed configuration to the fully deformed position. The size, dimensions, and resiliency of the example frame 60 and of the example contactors 62 and 64 is further predetermined such that, when the forces F on the example frame 60 are released, the example frame 60 overcomes the suction established by the low pressure within the closed chamber and the frame self-reconfigures from the fully deformed position to the undeformed position without application of external force. Manually gripping (or squeezing) and releasing the opposite outer sides of the example frame along the main axis A can thus create a popping or snapping sound.

III. Third Example Toy

Referring now to FIGS. 11-18 of the drawing, a third example toy 120 constructed in accordance with, and embodying, the principles of the present invention will be described. The example toy 120 comprises a cord 130, a first contactor 132, and a second contactor 134. The first and second contactors 132 and 134 are supported by first and second handles 136 and 138, respectively. The example cord 130 extends between the first and second handles 136 and 138. The example cord 130, first contactor 132, and second contactor 134 are resiliently deformable. The first contactor 132 defines a first contacting surface 140 and a first concave surface 142, and the second contactor 134 defines a second contacting surface 144 and a second concave surface 146. The example cord 130 and example handles 136 and 138 support the first and second contactors 132 and 134 such that the first contacting surface 140 faces and is substantially aligned with the second contacting surface 144 along a main axis A.

Figure 11:
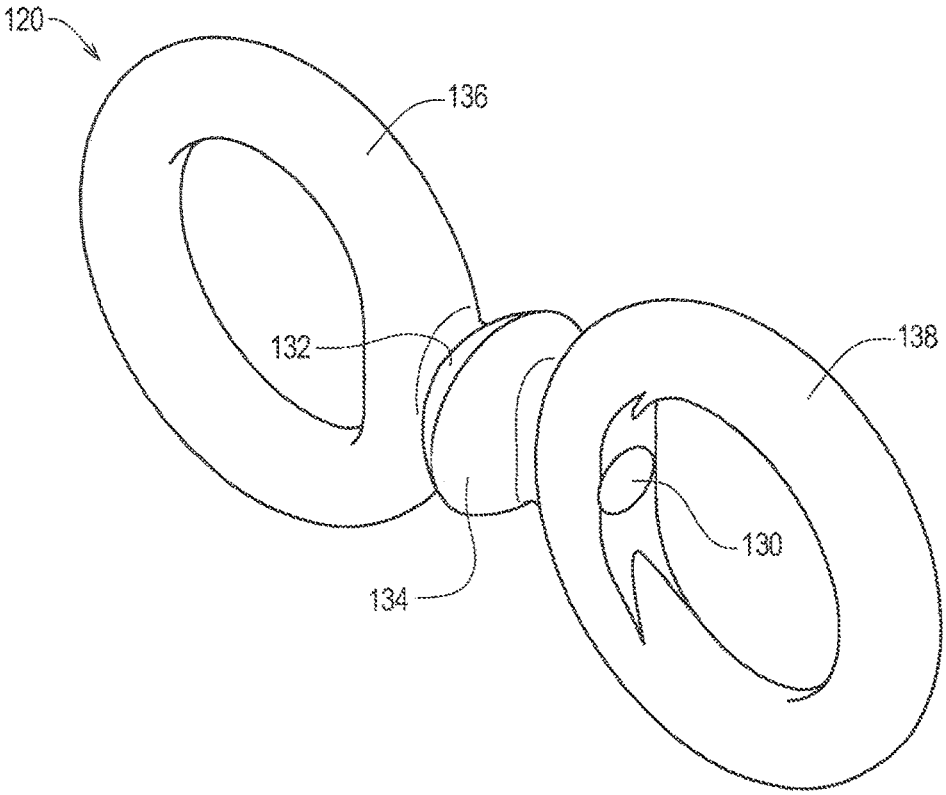
FIG. 11 is a perspective front view of a third example interactive toy of the present invention in a closed configuration.
Figure 12:
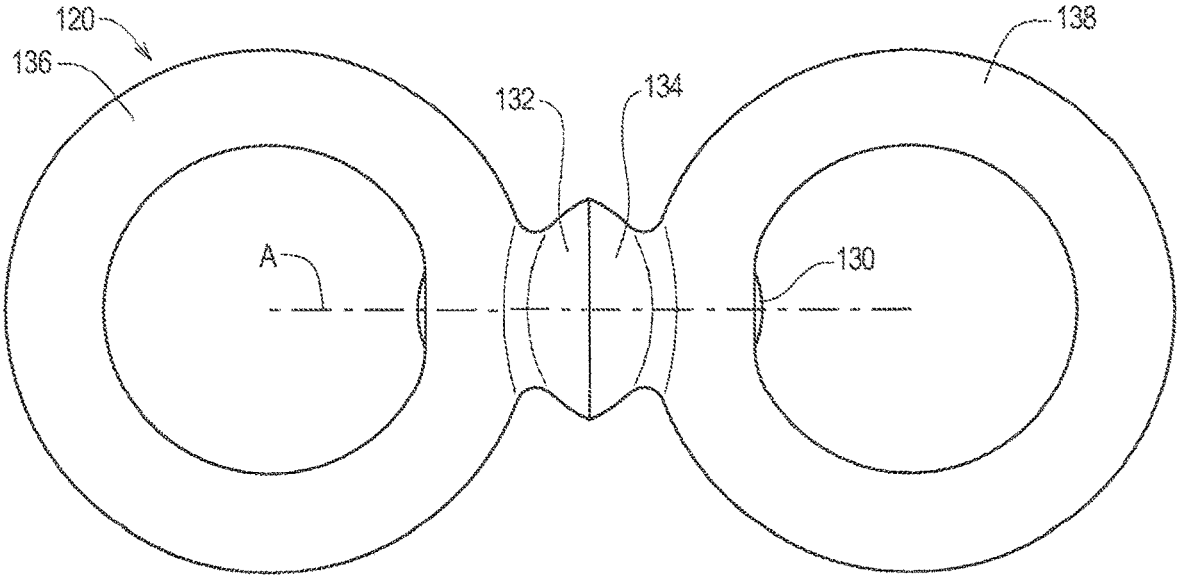
FIG. 12 is a first elevation view of the third example interactive toy in the closed configuration.
Figure 13:
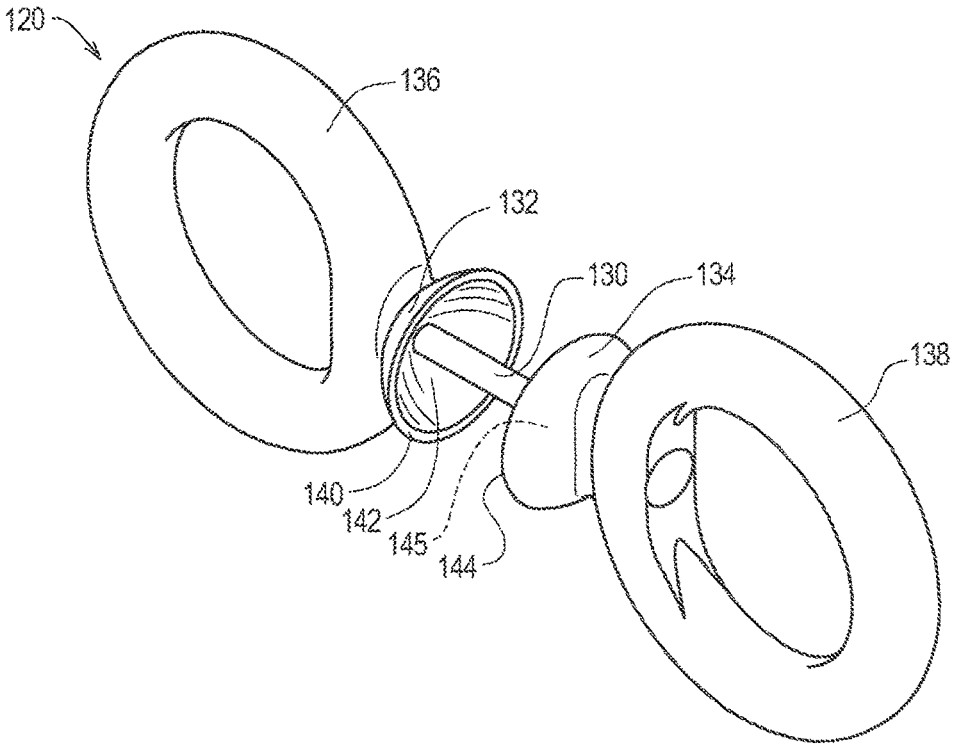
FIG. 13 is a perspective front view of the third example interactive toy of the present invention in an open configuration.
Figure 14:
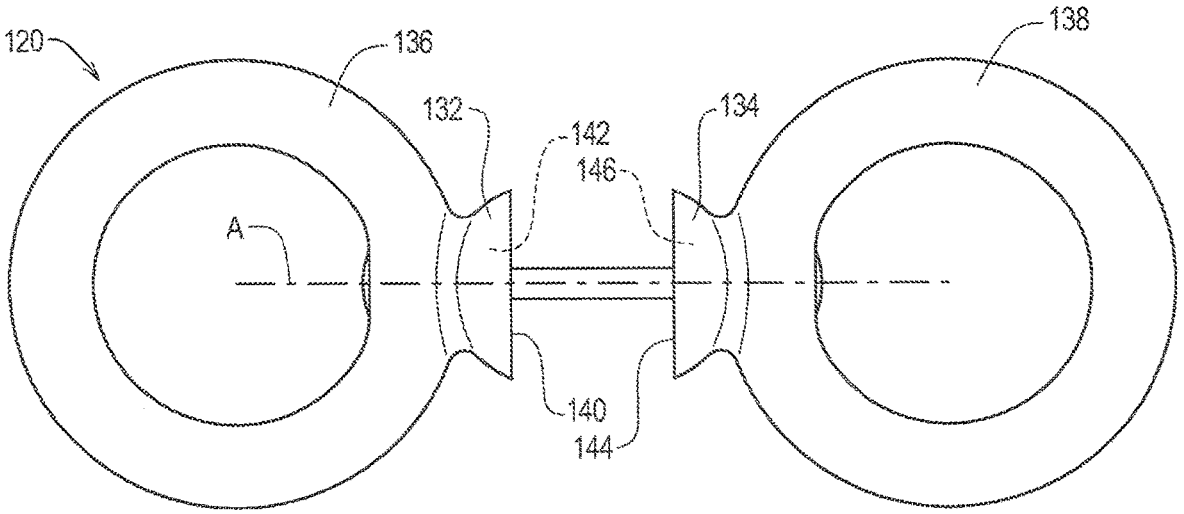
FIG. 14 is a first elevation view of the third example interactive toy in the open configuration.
Figure 15:
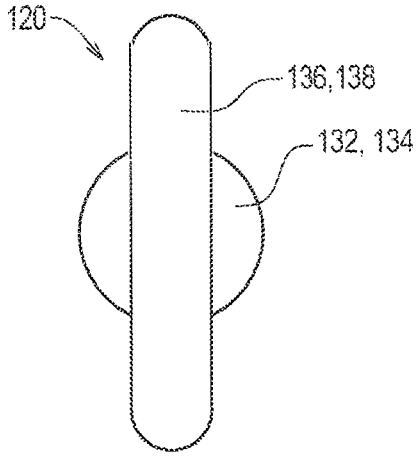
FIG. 15 is a first side elevation view of the third example interactive toy, the opposite side view being identical.
Figure 16:
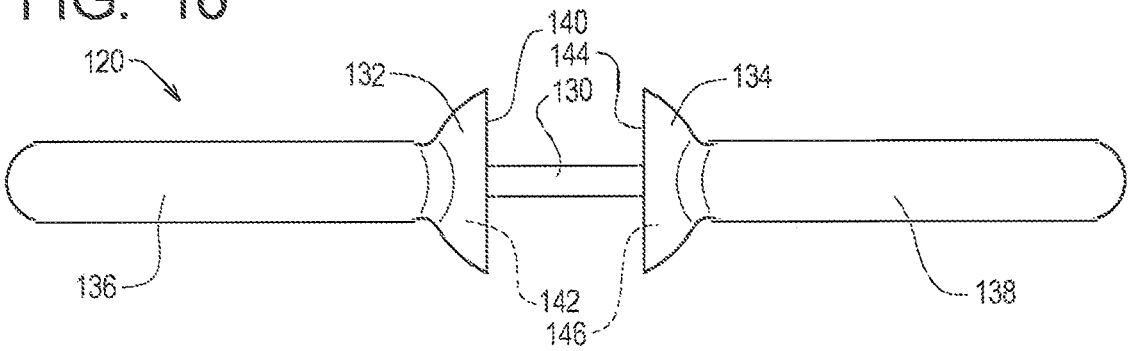
FIG. 16 is a top plan view of the third example interactive toy, the bottom plan view being identical.
Figure 17:
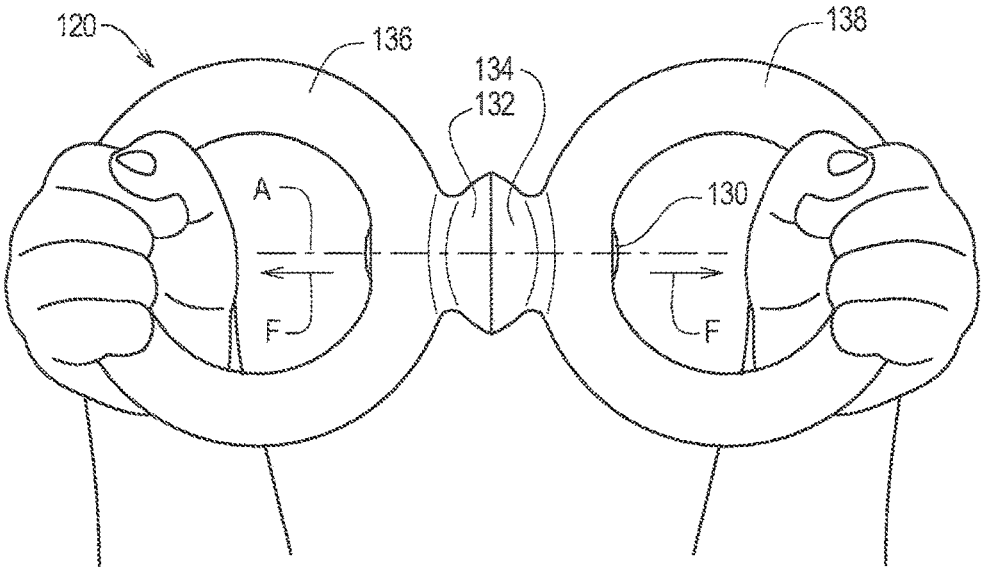
FIG. 17 is a front elevation view illustrating use of the third example interactive toy in the closed configuration.
Figure 18:
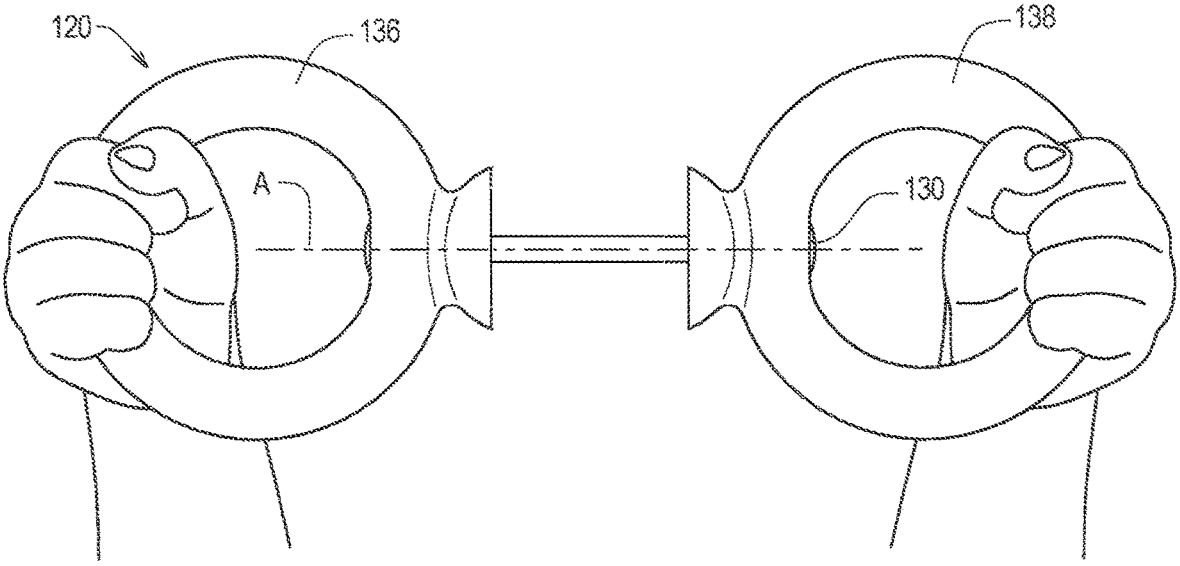
FIG. 18 is a front elevation view illustrating use of the third example interactive toy in the open configuration.

When the cord 130 is in a retracted configuration, the toy 120 is in a closed configuration as shown in FIGS. 11 and 12, and 17, and the first contacting surface 140 is in contact with the second contacting surface 142 to define a closed chamber that traps air. The cord 130 biases the first and second contactors 132 and 134 in opposite directions (towards each other) along the main axis A. The closed chamber is sealed as long as the first and second contacting surfaces 140 and 144 are held in contact by the cord 130. Applying opposite forces F on the handles 136 and 138 as shown in FIG. 18 deforms the cord 130 into an extended configuration (FIGS. 13, 14, 16, and 18) such that the first and second contacting surfaces 140 and 144 are moved away from each other along the main axis A and disengage. When the first and second contacting surfaces disengage, the reduced pressure air within the closed chamber and the resilient deformability of at least one of the first and second contactors 132 and 134 causes a snapping or popping sound.

The size, dimensions, and resiliency of the example cord 130 and of the example contactors 132 and 134 is predetermined such that deliberate application of manual force may be used to alter the cord 130 from the retracted configuration to the extended configuration. The size, dimensions, and resiliency of the example cord 130 and of the example contactors 132 and 134 is further predetermined such that, when the forces F on the example cord 130 are released, the example cord 130 self-returns to the retracted configuration.

IV. First Example Manufacturing Method

Figure 19:
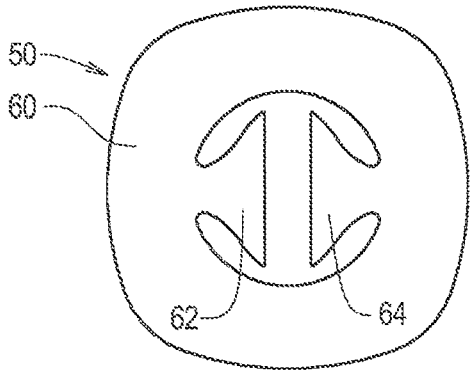
FIG. 19 is a front elevation view of the second example interactive toy molded as a complete component.

FIG. 19 illustrates that the example frame 60 and first and second contactors 62 and 64 of the second example toy 50 may be integrally formed of a molded flexible or resiliently deformable material. The molded resiliently deformable material allows the example toy 50 to be removed from a conventional two-part mold. The first and second example toys 20 and 50 may be made using the method of FIG. 19 using the same flexible or resiliently deformable material.

V. Second Example Manufacturing Method

Figure 20:
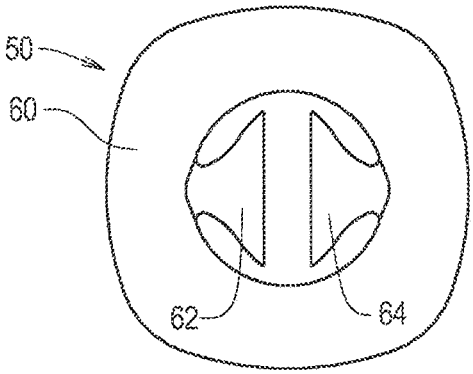
FIG. 20 is a front elevation view of the second example interactive toy formed from multiple components.
Figure 21A:
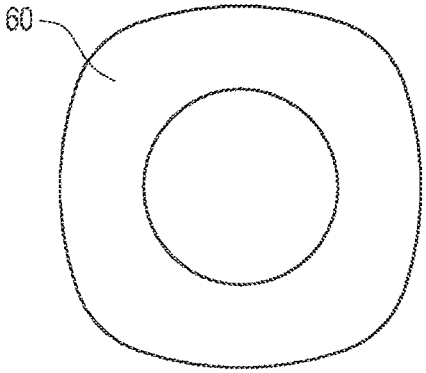
FIGS. 21A-21D illustrate an example process of fabricating and assembling the second example interactive toy from multiple components.
Figure 21B:
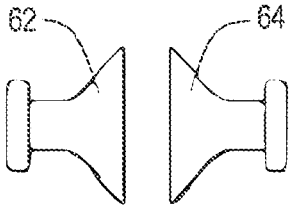
Figure 21C:
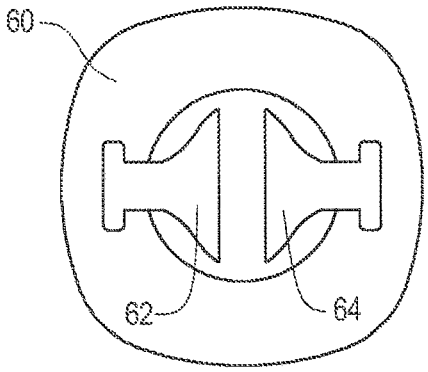
Figure 21D:
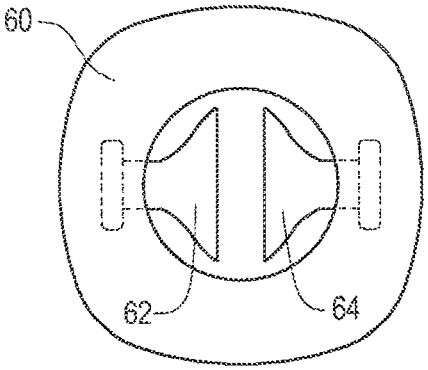

FIG. 20 illustrates that the example frame 60 and first and second contactors 62 and 64 of the second example toy 50 may be made of three separate components. More specifically, the example frame 60 is a first component as shown in FIG. 21A, and the first and second contactors 62 and 64 are second and third components as shown in FIG. 21B. The second and third components forming the first and second contactors 62 and 64 may be joined to the first component forming the frame 60. Alternatively, the first component forming the frame 60 may be overmolded around a portion of the second and third components forming the first and second contactors 62 and 64 as shown in FIGS. 21C and 21D. The first example toy 20 may be made using the method depicted in FIGS. 20 and 21A-21D and of the same flexible or resiliently deformable material.

VI. Third Example Manufacturing Method

Figure 22:
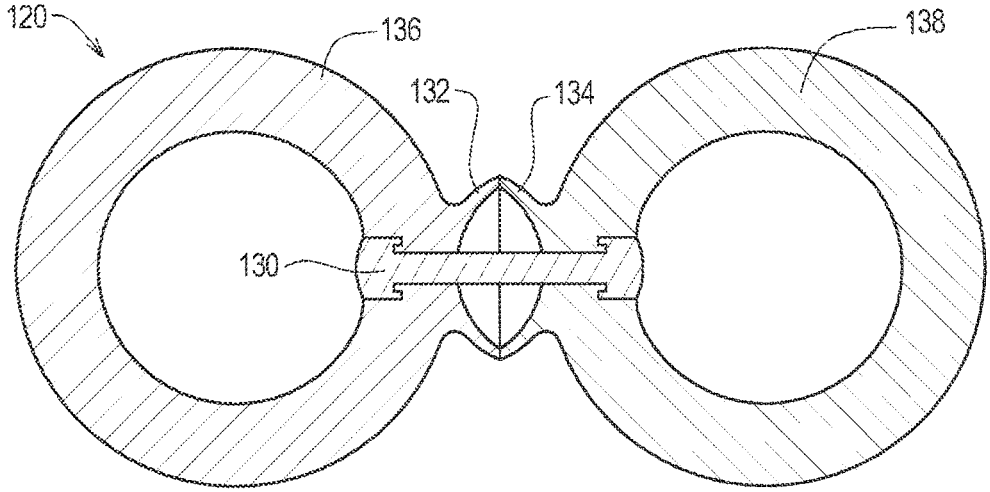
FIG. 22 is a section view illustrating an example construction of the third example interactive toy in the closed configuration.
Figure 23:
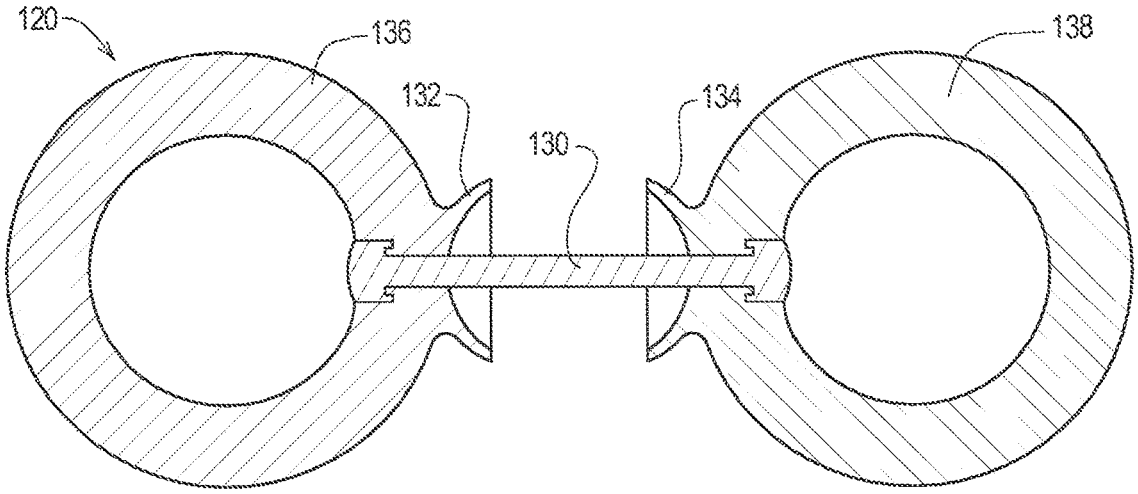
FIG. 23 is a section view illustrating an example construction of the third example interactive toy in the open configuration.
Figure 24:
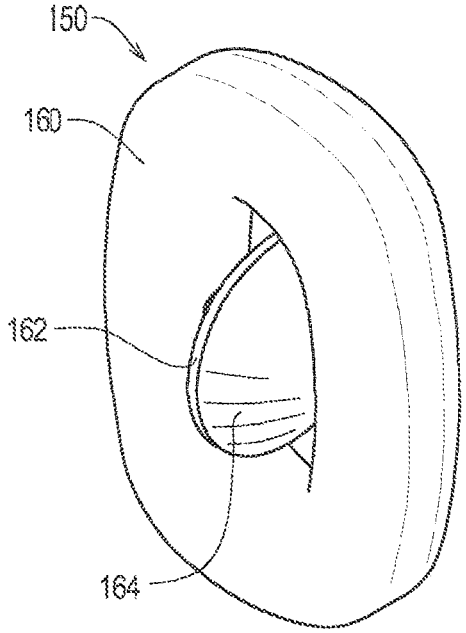
FIG. 24 is a perspective front view of a fourth example interactive toy of the present invention.
Figure 25:
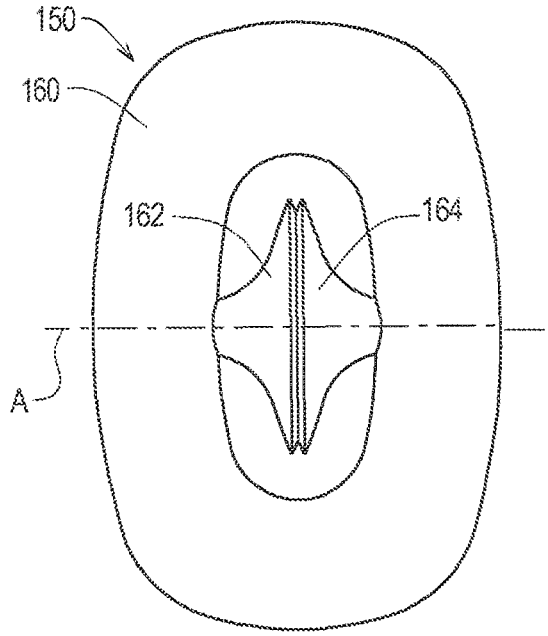
FIG. 25 is a first elevation view of the fourth example interactive toy, the opposite elevation view being identical.
Figure 26:
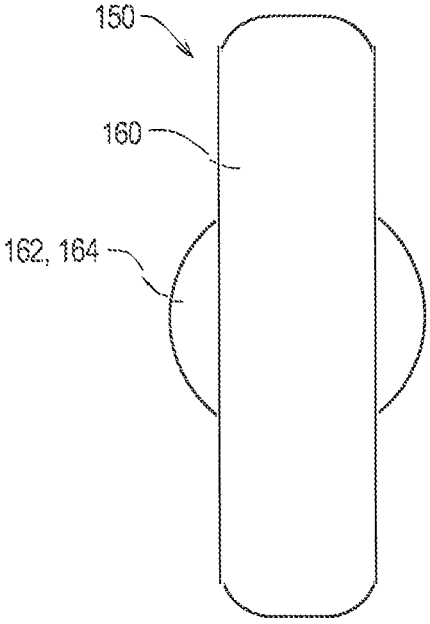
FIG. 26 is a second elevation view of the fourth example interactive toy, the opposite elevation view being identical.
Figure 27:
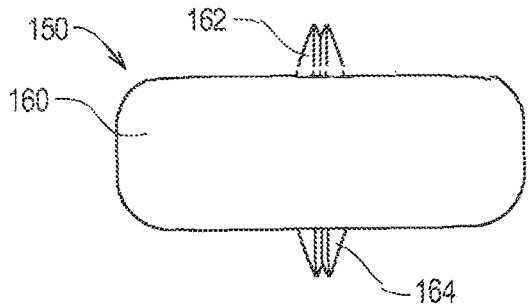
FIG. 27 is a top plan view of the fourth example interactive toy, the bottom plan view being identical.
Figure 28:
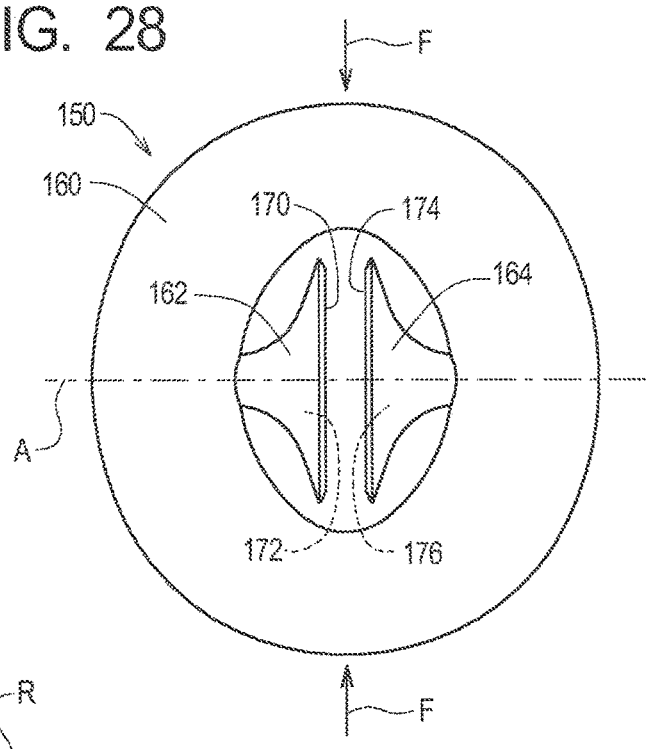
FIG. 28 is a front elevation view illustrating use of the fourth example interactive toy in an expanded configuration.

FIGS. 22 and 23 illustrate that the example cord 130, the example first and second contactors 132 and 134, and the first and second handles 136 and 138 of the third example toy 120 may be made of three separate components. More specifically, the example cord 130 is formed by a first component, the first contactor 132 and first handle 136 are formed by a second component, and the second contactor 134 and second handle 138 are formed by a third component. The second and third components may be joined to the first component forming the cord 130. Alternatively, the second and third components may be over-molded over portions of the first component as shown in FIGS. 22 and 23.

VII. Fourth Example Toy

Referring now to FIGS. 24-29 of the drawing, a fourth example toy 150 constructed in accordance with, and embodying, the principles of the present invention will be described. The example toy 150 comprises a frame 160, a first contactor 162, and a second contactor 164. The example frame 160, first contactor 162, and second contactor 164 are resiliently deformable. The first contactor 162 defines a first contacting surface 170 and a first concave surface 172, and the second contactor 164 defines a second contacting surface 174 and a second concave surface 176. The example frame 160 supports the example first and second contactors 162 and 164 such that the first contacting surface 170 faces and is substantially aligned, along a main axis A, with the second contacting surface 174.

When the frame 160 is in an undeformed configuration as shown in FIGS. 24, 25, 27, and 29, the first contacting surface 170 is in contact with the second contacting surface 172 to define a closed chamber that traps air. The frame 160 biases the first and second contactors 162 and 164 in opposite directions (towards each other) along the main axis A. Applying a force on the frame 160 as shown by arrows F in FIG. 15 deforms the frame 160 into a deformed configuration (FIG. 28) such that the first and second contacting surfaces 170 and 174 move away each other along the main axis A against the biasing force and disengage from each other. The closed chamber is sealed as long as the first and second contacting surfaces 170 and 174 are held in contact. As the frame 160 moves from the undeformed configuration to the deformed configuration, the first and second contacting surfaces 170 and 174 disengage from each other. As the first and second contacting surfaces 170 and 174 disengage from each other, the reduced pressure air within the closed chamber and the resilient deformability of at least one of the first and second contactors 162 and 164 causes a snapping or popping sound.

The fourth example frame 160 is in the form of a close ring, and the example first and second contactors 162 and 164 are supported on opposite inner surfaces defined the ring-shaped frame 160. The example first and second contacting surfaces 170 and 17 4 are annular. The example first and second concave surfaces 172 and 176 are substantially parabolic in cross-section.

The size, dimensions, and resiliency of the example frame 160 and of the example contactors 162 and 164 is predetermined such that deliberate application of manual force may be used to alter the frame from the undeformed configuration to the fully deformed position. The size, dimensions, and resiliency of the example frame 160 and of the example contactors 162 and 164 is further predetermined such that, when the forces F on the example frame 160 are released, return forces R created by the example frame 160 cause the frame self-reconfigures from the deformed configuration to the undeformed configuration without application of external force. Manually gripping (or squeezing) and releasing the opposite outer sides of the example frame in a direction perpendicular to the main axis A can thus create a popping or snapping sound.

In addition, either the first example method depicted in FIG. 19 or the second example method depicted in FIGS. 20 and 21A-21D may be used to make the fourth example toy 150 by taking the part from the mold while at least the frame 160 is still warm and supporting the part with a jig (not shown) that deforms the still warm frame 160 such that the first and second contactors 162 and 164 are held in contact as shown in FIGS. 24-29. The part is allowed to cool such while the first and second contactors 162 and 164 remain in contact, and the cooled part retains the shape depicted in FIGS. 24-29.

VIII. Fifth Example Toy

Figure 30:
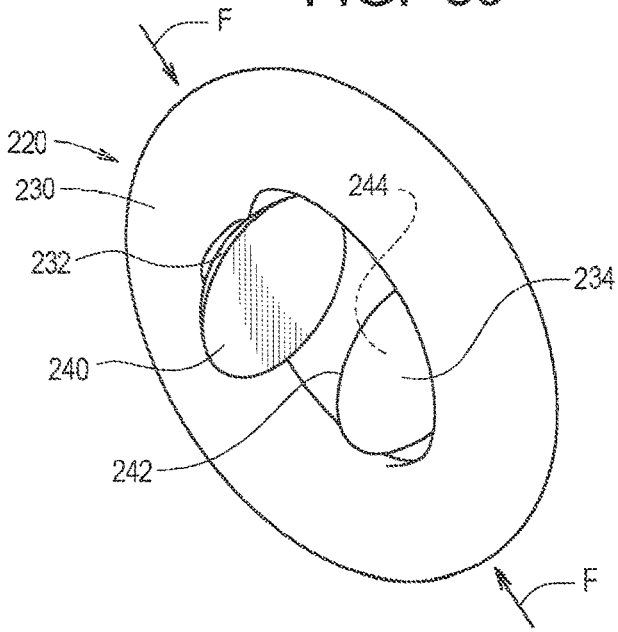
FIG. 30 is a perspective front view of a fifth example interactive toy of the present invention.

Referring next to FIG. 30 of the drawing, depicted therein is a fifth example toy 220 constructed in accordance with, and embodying, the principles of the present invention. The example toy 220 comprises a frame 230, a first contactor 232, and a second contactor 234. The example frame 230, first contactor 232, and second contactor 234 are resiliently deformable. The first contactor 232 defines a first contacting surface 240, and the second contactor 234 defines a second contacting surface 242 and a concave surface 244. The example first contacting surface 240 is flat. The example frame 222 supports the first and second contactors 232 and 234 such that the first contacting surface 240 faces and is substantially aligned with the second contacting surface 242 along a main axis.

When the frame 230 is in an undeformed configuration as shown in FIG. 30, the first contacting surface 240 is spaced from the second contacting surface 242. The frame 230 biases the first and second contactors 232 and 234 in opposite directions (away from each other) along the main axis A. Applying a force on the frame 230 as shown by arrows Fin FIG. 30 deforms the frame 230 into a contact configuration such that the first and second contacting surfaces 240 and 242 move toward each other along the main axis A and engage each other to define a closed chamber that traps a predetermined volume of air. The closed chamber is sealed as long as the first and second contacting surfaces 240 and 242 are held in contact. Further application of force in the direction shown by arrows F into a fully deformed configuration forces at least a portion of the predetermined volume of air out of closed chamber, creating low air pressure within the closed chamber relative to ambient air pressure outside of the closed chamber. At this point, releasing the force shown by arrows Fallows the frame 230 to return to the undeformed configuration. As the frame 230 moves through the contacting configuration back into the undeformed configuration, the first and second contacting surfaces 240 and 242 disengage with each other. As the first and second contacting surfaces 240 and 242 disengage with each other, the reduced pressure air within the closed chamber and the resilient deformability of at least one of the first and second contactors 232 and 234 causes a snapping or popping sound.

The fifth example frame 230 is annular (e.g., toroidal), and the example first and second contactors 232 and 234 are supported on opposing inner sides defined the frame 230. The example first contacting surface 240 is circular and flat, and second contacting surface 242 is annular and flat. The example concave surface 244 is substantially parabolic in cross-section.

The size, dimensions, and resiliency of the example frame 230 and of the example contactors 232 and 234 is predetermined such that deliberate application of manual force may be used to alter the frame from the undeformed configuration to the fully deformed position. The size, dimensions, and resiliency of the example frame 230 and of the example contactors 232 and 234 is further predetermined such that, when the forces F on the example frame 230 are released, the example frame 230 overcomes the suction established by the low pressure within the closed chamber and the frame self-reconfigures from the fully deformed position to the undeformed position without application of external force. Manually gripping (or squeezing) and releasing the opposite outer sides of the example frame along the main axis A can thus create a popping or snapping sound.

A contactor defining a flat, circular contacting surface such as the example first contacting surface 240 need not be resiliently deformable and instead may be rigid.

The fifth example toy 220 illustrates that only one of the two contactors of any of the other example toys 20, 50, 120, 150, and 250 described herein defines a concave surface capable of trapping and expelling air to create suction that creates a popping or snapping sound when the contactors are separate.

IX. Sixth Example Toy

Figure 31:
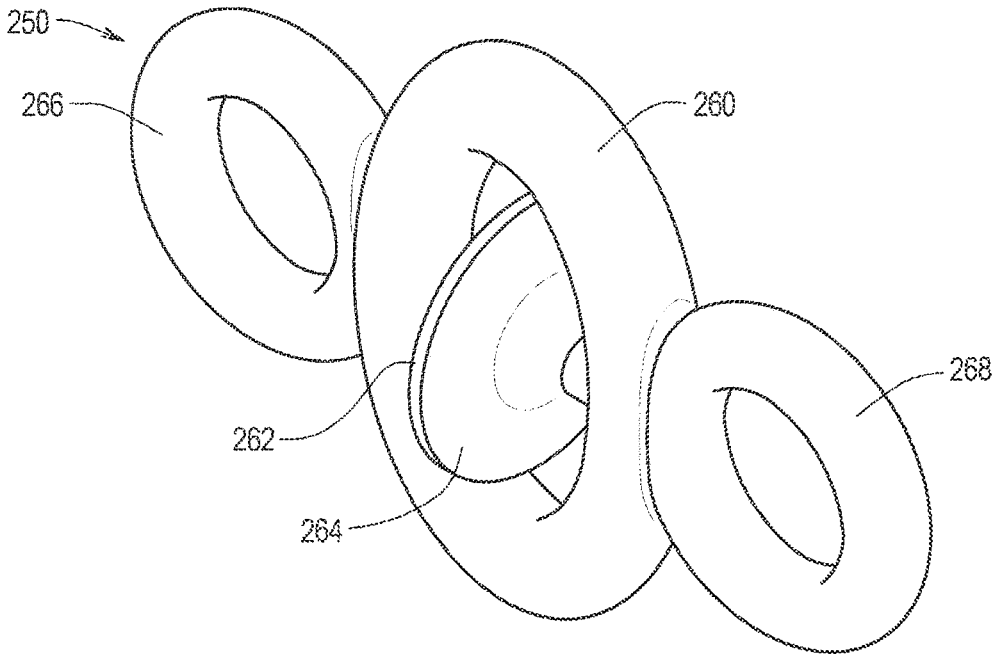
FIG. 31 is perspective view of a sixth example interactive toy of the present invention.
Figure 32:
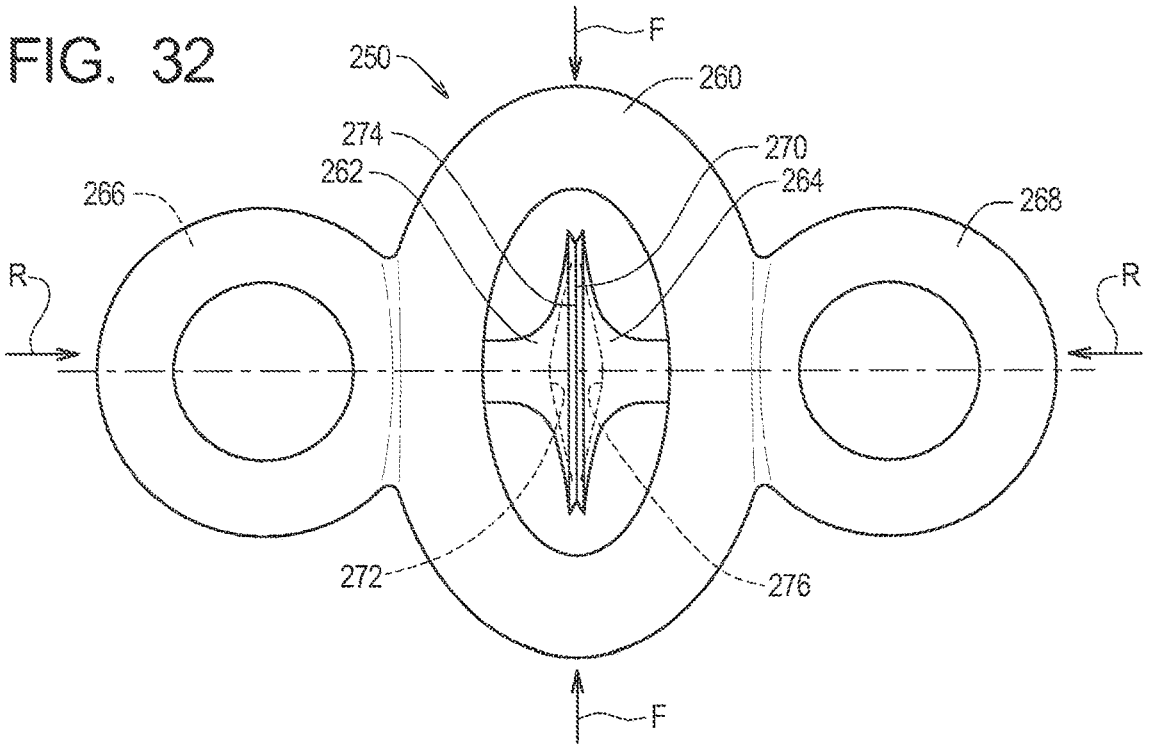
FIG. 32 is an elevation view of the sixth example interactive toy of the present invention.

Referring now to FIGS. 31 and 32 of the drawing, a sixth example toy 250 constructed in accordance with, and embodying, the principles of the present invention will be described. The example toy 250 comprises a frame 260, a first contactor 262, a second contactor 264, a first handle 266, and a second handle 268. The example frame 260, first contactor 262, and second contactor 264 are resiliently deformable. The first contactor 262 defines a first contacting surface 270 and a first concave surface 272, and the second contactor 264 defines a second contacting surface 274 and a second concave surface 276. The example frame 260 supports the example first and second contactors 262 and 264 such that the first contacting surface 270 faces and is substantially aligned, along a main axis A, with the second contacting surface 274.

When the frame 260 is in an undeformed configuration, the first contacting surface 270 is in contact with the second contacting surface 272 to define a closed chamber that traps air. The frame 260 biases the first and second contactors 262 and 264 in opposite directions (towards each other) along the main axis A. Applying a force on the frame 260 by engaging the first and second handles 266 and 268 and displacing the handles 266 and 268 away from each other deforms the frame 260 into a deformed configuration such that the first and second contacting surfaces 270 and 274 move away each other along the main axis A against the biasing force and disengage from each other. The closed chamber is sealed as long as the first and second contacting surfaces 270 and 274 are held in contact. As the frame 260 moves from the undeformed configuration to the deformed configuration, the first and second contacting surfaces 270 and 274 disengage from each other. As the first and second contacting surfaces 270 and 274 disengage from each other, the reduced pressure air within the closed chamber and the resilient deformability of at least one of the first and second contactors 262 and 264 causes a snapping or popping sound.

The sixth example frame 260 is in the form of a close ring, and the example first and second contactors 262 and 264 are supported on opposite inner surfaces defined by the ring-shaped frame 260. The example first and second handles 266 and 268 are connected to exterior surfaces the frame 260 adjacent to the first and second contactors 262 and 264. The example first and second contacting surfaces 270 and 274 are annular. The example first and second concave surfaces 272 and 276 are substantially parabolic in cross-section.

The size, dimensions, and resiliency of the example frame 260 and of the example contactors 262 and 264 is predetermined such that deliberate application of manual force may be used to alter the frame from the undeformed configuration to the fully deformed position. The size, dimensions, and resiliency of the example frame 260 and of the example contactors 262 and 264 is further predetermined such that, when the forces F on the example frame 260 are released, return forces R created by the example frame 260 cause the frame self-reconfigures from the deformed configuration to the undeformed configuration without application of external force. Manually gripping (or squeezing) and releasing the opposite outer sides of the example frame in a direction perpendicular to the main axis A can thus create a popping or snapping sound.

Figure 29:
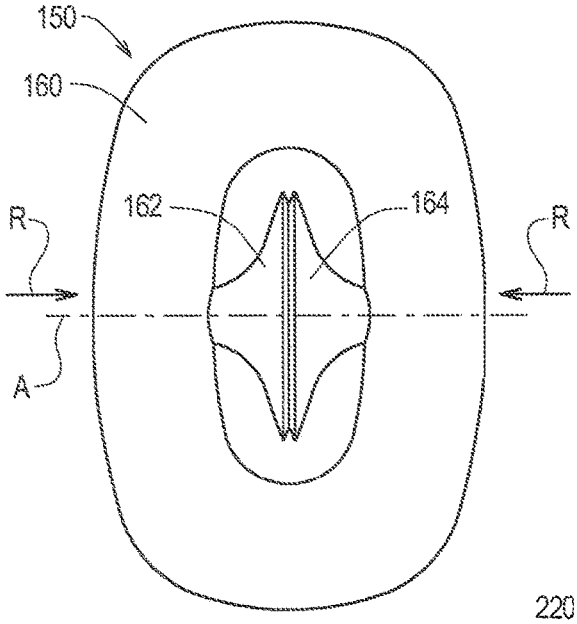
FIG. 29 is a front elevation view illustrating use of the fourth example interactive toy in a compressed configuration.

In addition, either the first example method depicted in FIG. 29 or the second example method depicted in FIGS. 20 and 21A-21D may be used to make the sixth example toy 250 by taking the part from the mold while at least the frame 260 is still warm and supporting the part with a jig (not shown) that deforms the still warm frame 260 such that the first and second contactors 262 and 264 are held in contact as shown in FIGS. 24-29. The part is allowed to cool such while the first and second contactors 262 and 264 remain in contact, and the cooled part retains the shape depicted in FIGS. 24-29.

X. Additional Considerations

The present invention may thus be embodied as an interactive toy system comprised of flexible and/or rigid components, made of a rubber or rubber-like material and/or plastic, with each component having one or more suction cups for releasable attachment to other components of the system. With said components also having suctions cups and/or smooth, non-porous surface in which to securely connect and release by way of suction/vacuum. In addition to one or more suction cups, each component also has a body portion(s). This body portion may extend beyond the region of a suction cup and terminate or may continue in one or more directions. The flexible nature of the rubber or rubber-like components allow for the suction based elements of the toy system to be squeezed, pressed, pushed or pulled together while the memory of the flexible rubber or rubber-like components causes the suction elements to self-release as the flexible materials naturally returns to their functionally intended/molded shape. When the suction elements release from one another the escaping vacuum emits an intended and desired audible 'POP' and/or 'SNAP' sound.

A related variant of a resiliently deformable frame employs a flexible and/or stretchable rubber or rubber-like material stem/strap that may be molded into and/or passes through the center of the suction elements of the system. The natural memory of the rubber or rubber-like material of the stem/strap is by functional design, utilized to pull the suction elements of the toy system back in contact with one another after they have been manually squeezed, pressed, pushed or pulled apart. The action of the flexible system being squeezed, pressed, pushed or pulled creates the desired audible 'POP' and/or 'SNAP' sounds. The flexible stem/strap pulls the suctions elements back together to reform the suction connection enabling the action to be repeated and replicated over and over again resulting in the desired 'POP' and/or 'SNAP' sounds.

It should be understood that the concepts described in connection with one embodiment of the invention may be combined with the concepts described in connection with another embodiment or various other embodiments of the invention. It should also be understood that the invention is not limited to the exact design or construction or method of operation illustrated and described above. Various changes and modifications may be made without departing from the spirit and the scope of the invention.

The invention claimed is:

1. A toy comprising:

a) a resiliently deformable member having an external surface;

b) a first contactor disposed on a first portion of the external surface, said first contactor defining a first contacting surface;

c) a second contactor disposed on a second portion of the external surface, said second contactor defining a second contacting surface;

d) wherein at least one of the first and second contactors defines a concave surface;

e) wherein the resiliently deformable member supports the first and second contactors for movement along a main axis between i) an engaged configuration in which the first contacting surface is in contact with the second contacting surface; and ii) a disengaged configuration in which the first contacting surface is disengaged from the second contacting surface;

f) wherein the resiliently deformable member biases the first and second contactors in opposite directions along the main axis and into the engaged configuration;

g) wherein application of a force on the resiliently deformable member displaces the first and second contactors in opposite directions along the main axis and into the disengaged configuration; and h) wherein the resiliently deformable member displaces the first and second contactors along the main axis from the disengaged configuration into the engaged configuration.

2. The toy as in claim 1 wherein the resiliently deformable member comprises a closed frame.

3. The toy as in claim 1, wherein the first and second contactors each define a concave surface.

4. The toy as in claim 1 a) wherein the first contactor defines the concave surface;

b) wherein the second contacting surface is flat.

5. The toy as in claim 4 wherein the first contactor is resiliently deformable and the second contactor is rigid.

6. The toy as in claim 1 wherein at least one of the first and second contactors is resiliently deformable.

7. The toy as in claim 1 wherein the first and second contactors are each resiliently deformable.

8. The toy as in claim 1 wherein the resiliently deformable member is toroidal.

9. A method of creating a sound comprising the steps of a) providing a resiliently deformable member having an external surface;

b) providing a first contactor disposed on a first portion of the external surface, said first contactor defining a first contacting surface;

c) providing a second contactor disposed on a second portion of the external surface, said second contractor defining a second contacting surface, wherein at least one of the first and second contactors defines a concave surface;

d) supporting the first and second contactors on the resiliently deformable member for movement along a main axis between i) an engaged configuration in which the first contacting surface is in contact with the second contacting surface; and ii) a disengaged configuration in which the first contacting surface is disengaged from the second contacting surface;

e) configuring the resiliently deformable member to bias the first and second contactors in opposition directions along the main axis and into the engaged configuration;

f) applying a force on the resiliently deformable member to displace the first and second contactors along the main axis and into the disengaged configuration;

g) removing the force from the resiliently deformable member when the first and second contactors are in the disengaged configuration to allow the resiliently deformable member to displace the first and second contactors along the main axis from the disengaged configuration into the engaged configuration.

10. The method as in claim 9 wherein the step of providing a resiliently deformable member further comprises providing a closed frame resiliently deformable member.

11. A toy comprising a) a closed frame having an external surface i) wherein the closed frame is resiliently deformable between an undeformed configuration and a deformed configuration;

b) a first contactor disposed on a first portion of the external surface, said first contactor defining a first contacting surface;

c) a second contactor disposed on a second portion of the external surface, said second contactor defining a second contacting surface;

d) wherein at least one of the first and second contactors defines a concave surface;

e) wherein the closed frame supports the first and second contactors for movement along a main axis between i) an engaged configuration in which the first contacting surface is in contact with the second contacting surface, and ii) a disengaged configuration in which the first contacting surface is disengaged from the second contacting surface;

f) wherein the closed frame biases the first and second contactors in opposite directions along the main axis and into the engaged configuration;

g) wherein application of a force on the closed frame displaces the first and second contactors in opposite directions along the main axis and into the disengaged configuration; and h) wherein the closed frame displaces the first and second contactors along the main axis from the disengaged configuration into the engaged configuration.

12. The toy as in claim 11 wherein the first and second contactors each define a concave surface.

13. The toy as in claim 11 wherein the first and second contactors are resiliently deformable.

14. The toy as in claim 11 a) wherein the first contactor defines the concave surface;

b) wherein the second contacting surface is flat.

15. The toy as in claim 14 a) wherein the first contactor is resiliently deformable; and b) wherein the second contactor is rigid.

16. The toy as in claim 15 wherein the closed frame is toroidal.

17. The toy as in claim 16 wherein at least one of the first and second contactors is resiliently deformable.

18. The toy as in claim 17 wherein the closed frame is toroidal.

19. The toy as in claim 11 wherein the closed frame is toroidal.

20. The toy as in claim 11 a) wherein the first contactor is rigid; and b) wherein the second contactor is resiliently deformable.

* * * * *